US008066850B2

(12) United States Patent
Trefz et al.

(10) Patent No.: US 8,066,850 B2
(45) **Date of Patent: *Nov. 29, 2011**

(54) APPARATUS TO PRODUCE COATED PAPER, CARDBOARD OR OTHER FIBROUS WEBS WITH AT LEAST ONE THERMO-SENSITIVE LAYER AND A METHOD TO OPERATE AN APPARATUS OF THIS TYPE

(75) Inventors: Michael Trefz, Heidenheim (DE); Thomas Kuchinke, Schwabisch-Gmund (DE)

(73) Assignee: Voith Patent GmbH, Heidenheim (DE)

( * ) Notice: Subject to any disclaimer, the term of this patent is extended or adjusted under 35 U.S.C. 154(b) by 141 days.

This patent is subject to a terminal disclaimer.

(21) Appl. No.: 12/542,919

(22) Filed: Aug. 18, 2009

(65) Prior Publication Data

US 2010/0051223 A1 Mar. 4, 2010

(30) Foreign Application Priority Data

Aug. 28, 2008 (DE) ..... 10 2008 041 419

(51) Int. Cl.
*D21H 11/00* (2006.01)

(52) U.S. Cl. ..... 162/265

(58) Field of Classification Search ..... 162/265; 118/261, 68
See application file for complete search history.

(56) References Cited

U.S. PATENT DOCUMENTS

| | | | | |
|---|---|---|---|---|
| 7,422,629 | B1 | 9/2008 | Rheims | |
| 2002/0066404 | A1 * | 6/2002 | Ueberschar et al. | 118/261 |
| 2010/0043700 | A1 * | 2/2010 | Trefz | 118/68 |
| 2010/0055333 | A1 * | 3/2010 | Trefz et al. | 427/372.2 |

FOREIGN PATENT DOCUMENTS

| | | | |
|---|---|---|---|
| EP | 1 538 262 | A1 | 6/2005 |
| WO | 04/001133 | A2 | 12/2003 |

OTHER PUBLICATIONS

La papeterie 275, Apr.-May 2006, pp. 6-14.
Revue de Papier Carton #85, Feb.-Mar. 2006, pp. 34-37.

* cited by examiner

*Primary Examiner* — Mark Halpern
(74) *Attorney, Agent, or Firm* — Taylor IP, P.C.

(57) ABSTRACT

The invention relates to an apparatus to produce coated paper, cardboard or other fibrous webs with at least one thermo-sensitive layer as a functional layer through the application of at least one liquid or paste-like thermo-sensitive coating medium onto a carrier web by way of a unit which forms a functional layer, the units each include at least one applicator device and one drying section following the applicator device. The two units are capable of being installed in series and each form at least one functional layer on the carrier web, whereby in the merging area between the two functional layer forming units a web turning device is located, creating a first web path and a device to bypass the web turning device, thus creating a second web path for the carrier web between the two functional layer forming units. The invention further relates to a method to operate an apparatus of this type.

12 Claims, 5 Drawing Sheets

APPARATUS TO PRODUCE COATED PAPER, CARDBOARD OR OTHER FIBROUS WEBS WITH AT LEAST ONE THERMO-SENSITIVE LAYER AND A METHOD TO OPERATE AN APPARATUS OF THIS TYPE

BACKGROUND OF THE INVENTION

1. Field of the Invention

The invention relates to an apparatus to produce coated paper, cardboard or other fibrous webs with at least one thermo-sensitive layer as a functional layer through the application of at least one liquid or paste-like thermo-sensitive coating medium onto a carrier web by way of a unit which forms a functional layer. The invention also relates to a method to operate an apparatus to produce coated paper, cardboard or other fibrous webs with at least one thermo-sensitive layer. The invention is also suitable for other webs that are suitable for recording mediums, such as films or textile substrates which are to be given a thermo-sensitive layer on one or both sides.

2. Description of the Related Art

A thermal sensitive or thermo-sensitive layer is to be understood to be a coating layer which, under the effect of heat, especially through contact with a heatable printing head, is suitable to provide an image of visually recognizable information by way of a color change. This may involve at least one color generator, one color developer and a fixing agent. Apparatuses to produce coated paper, cardboard or other fibrous webs with at least one thermo-sensitive layer in the form of thermo papers through the application of a liquid or paste-like thermo-sensitive coating medium onto a carrier web by way of a curtain coater are already known for example from La papeterie 275, April-May 2006, pages 6-14 and Revue de Papier Carton #85, February-March 2006, pages 34-37

Here, a dryer section is located after the applicator device which is in the embodiment of a curtain coater. In order to avoid curling, water is applied to the backside to improve laying flat. With this type of basic configuration a single thermo-sensitive layer can be applied. Further developments in the area of thermo papers and the expansion of the scope of application have led to the development of high quality thermo papers. These are coated either on both sides with one thermo-sensitive coating or feature a cover layer as a protective layer over the thermo-sensitive layer. In order to achieve these additional functional layers, units which form functional layers are to be provided in accordance with the number of individual layers. These units comprise applicator devices with coating medium supply systems allocated to them, followed by a drying section in order to ensure the required dry content. Such devices are however characterized by a considerable space requirement and, because of the multitude of functional layer forming units, are cost intensive. However, depending upon the type of coated fibrous web that is to be produced, individual applicator devices and the following drying sections are not required, so that over capacities exist over large parts of the entire operational area and the apparatus is not utilized to its optimum.

What is needed in the art is an apparatus to produce coated paper, cardboard or other fibrous webs, especially in the form of thermo papers, so that the disadvantages existing in the current state of the art are avoided. The apparatus should be characterized by a simple construction with few components and should be capable of coating one carrier web several times on one side, especially twice, or capable of coating it on both sides with at least one coating. Change-over to run the different types of coated paper, cardboard or other fibrous webs is to be simple and involve few control changes and should be possible in a timely manner, without conversion measures to meet current demands.

SUMMARY OF THE INVENTION

An embodiment of the present invention provides an apparatus to produce coated paper, cardboard or other fibrous webs with at least one thermo-sensitive layer as a functional layer having only two units capable of being installed in series whereby each form at least one functional layer, whereby in the merging area between the two functional layer forming units a web turning device is located, creating a first web path and a device to bypass the web turning device, thus creating a second web path for the carrier web between the two functional layer forming units.

The inventive apparatus is characterized by the provision of only two functional layer forming units which, due to the intelligent arrangement and control of their operational modes are suitable for producing a multitude of different types of coated paper, cardboard or other fibrous webs at a low expenditure, without conversion of the apparatus. This provides the opportunity of a quick changeover and optimal utilization of the individual components of the individual functional layer forming units.

In the simplest scenario the device to bypass the web turning device includes guide and/or control elements to guide the carrier web which are located and designed to be suitable to create a branching of the web path after the first functional layer forming unit by creating a bypass around the web turning device by and bringing together the two web paths before the second functional layer forming unit. By creating two parallel web paths the merging region can be relatively short and compact which has an overall favorable effect upon the space requirement for the apparatus.

The applicator device and the drying section in a functional layer forming unit are designed and arranged so that the carrier web is guided inside the functional layer forming unit without a directional change, viewed in longitudinal direction of the apparatus or respectively without reversal of the started turn direction, whereby it is ensured that the coated surface is subjected to a subsequent drying.

Basically two options exist with respect to the layout and orientation of the components of the functional layers forming units relative to each other. According to a first arrangement they are arranged preferably in a common horizontal plane, in other words without being offset against each other in a vertical direction. According to a second arrangement the layout is offset in vertical direction. The first arrangement offers a very compact unit with regard to height extension, while the second arrangement permits an adaptation to space availability factors or respectively to the web progression.

The layout of the individual functional layer forming units can also differ. According to one embodiment the two functional layer forming units are laid out, when viewed in a longitudinal direction of the apparatus, are arranged in tandem, so that when the carrier web runs through the merging region between the two functional layer forming units along the second web path, the path direction of the carrier web in the longitudinal direction of the apparatus is without directional change. Preferably the two functional layer forming units are positioned in a horizontal plane in this case.

According to an additional embodiment the placement of the functional layer forming units viewed in a flow direction of the carrier web occurs successively so that when the carrier web travels in the merging region between the two functional layer forming units along the second web path, the direction of travel of the carrier web is characterized by at least one directional change in the longitudinal direction of the apparatus. The provided directional change allows a placement in vertically offset planes, whereby the offset in a longitudinal direction between the two functional layer forming units can be minimized. A second embodiment is characterized by a high degree of compactness in the longitudinal direction and at the same time by optimum usage of available space in the vertical direction. In an especially advantageous further development of the second embodiment the placement of the second functional layer forming unit as viewed spatially in the longitudinal direction of the apparatus, occurs completely within the region of extension of the first functional layer forming unit.

The two web paths in the merging region can be located after one of the functional layer forming units, viewed in the longitudinal direction of the apparatus, whereby the two web paths of the merging region can be aligned in the horizontal or in the vertical direction. The final layout occurs in conjunction with the available space. The applicator device for the individual functional layer forming unit includes a multi-layer curtain coater which permits an application of coating medium in the form of a single or multi-layer curtain produced on a break-line. The curtain coater includes at least one applicator nozzle extending in a width direction of the carrier web, which is connected through at least one coating medium feed line to the coating medium supply system.

The nozzle may be in the embodiment of a slot die or slide die.

For a quick changeover between different types of coating layers that are to be applied, at least two coating medium supply systems can be provided, subject to the demands upon the coating medium may be accessed alternately. For example, the alternative access can be accomplished through selective coupling of the coating medium feed line with different coating medium supply systems.

The individual drying section of a functional layer forming unit includes at least one drying device. This may be in the form of contactless drying, especially a hot air dryer which is gas or steam heated. Other drying systems, such as infrared drying are also contemplated. The drying section is laid out for the purpose of achieving the dry content that is to be achieved in the layer that was applied with the upstream applicator device. The dryer section is preferably straight; however, it may also be characterized by a curved, or other progression.

In a continuous operational mode the carrier web is usually unwound from a fibrous stock roll and pulled through the apparatus by appropriate pulling devices. After the second functional layer forming unit, rewinding of the coated fibrous web occurs by a rewinder.

In addition to thermo-sensitive layers other layers can also be applied as functional layers, for example cover layers in the form of protective layers. The latter are characterized by a lower basis weight in the range of 1 to 6 g/m$^2$ than the thermo-sensitive layers whose basis weight is selected preferably in the range of 2 to 7 g/m$^2$.

The inventive method for operating of an apparatus for the production of coated paper, cardboard or other fibrous webs with at least one thermo-sensitive layer as a functional layer, by way of an application of liquid or paste-like thermo-sensitive coating mediums onto a carrier web is characterized in that it can be operated in various operational modes. In a first operational mode, only one of the functional layer forming units is activated. In a second operational mode, the carrier web is routed over the first web path between both functional layer forming units. In a third operational mode, the carrier web is routed over the second web path between both functional layer forming units. Depending upon relative placement to each other of the individual functional layer forming units, an orientation change between the top and bottom side of the carrier web can be made between the two functional layer forming units by way of the web turning device in the second operational mode, so that in the second functional layer forming unit either the same side, as in the first functional layer forming unit, or the opposite side is coated.

The inventive solution is suitable especially advantageously for the production of thermo papers. It can however also be applied for other materials in web form and which are suitable as recording mediums, such as, for example, films or textile materials.

BRIEF DESCRIPTION OF THE DRAWINGS

The inventive solution is explained below with reference to the drawings. The following details are illustrated.

Corresponding reference characters indicate corresponding parts throughout the several views. The exemplifications set out herein illustrate embodiments of the invention (, in one form,) and such exemplifications are not to be construed as limiting the scope of the invention in any manner.

DETAILED DESCRIPTION OF THE INVENTION

Figure 1A:
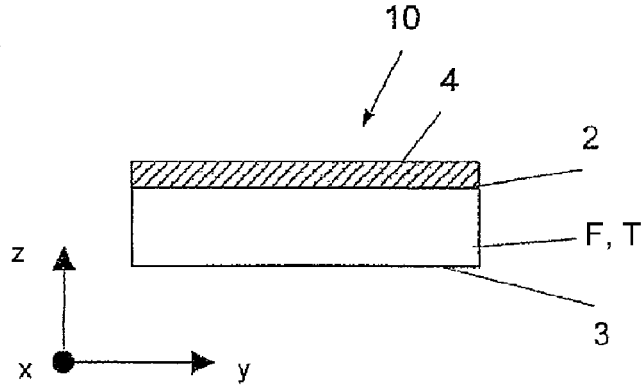
FIGS. 1*a* to 1*c* illustrate cross sectionals of the composition of different types of coated paper, cardboard or other fibrous webs.
Figure 1B:
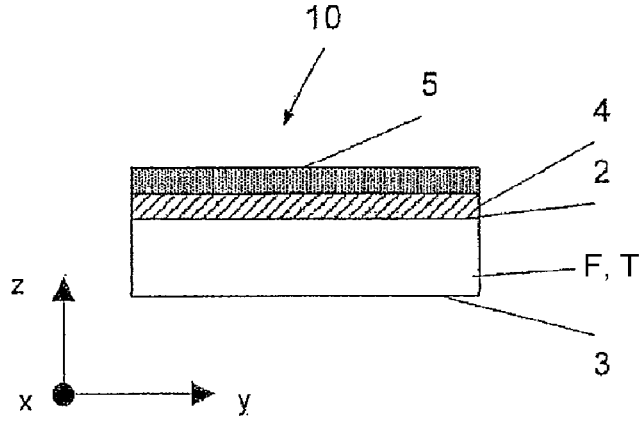
Figure 1C:
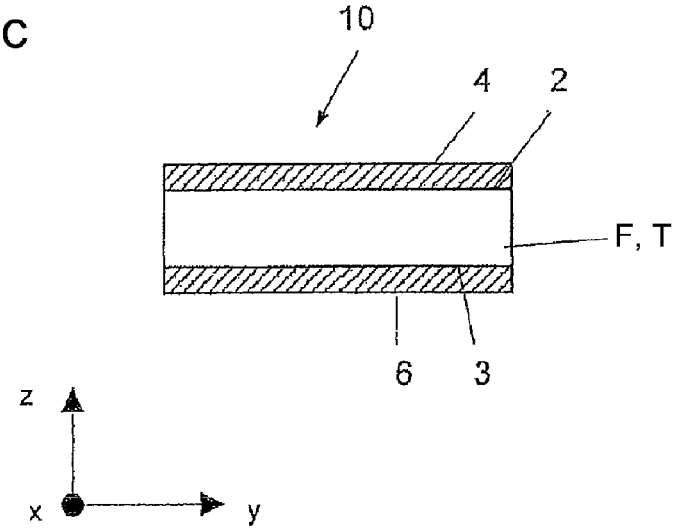

Referring now to the drawings, and more specifically to FIGS. 1*a* through 1*c* which clarify in greatly simplified depictions respective cross sections through a coated fibrous web 10, especially thermo paper 10, as well as possible basic variations of these, as can be produced with apparatus 1. Coated fibrous web 10 includes a fibrous web F, which is a carrier web T, which preferably is in the form of a paper web and which is characterized by a functional layer 4 and/or 6 on at least one surface, that is on top side 2, and/or on bottom side 3.

Layer 4 or 6 is to be understood to be a medium which is uniformly applied over the entire surface of fibrous web F and which, through drying and other processes, forms one entity with fibrous web F. Fibrous web 10 is hereby characterized in a XYZ coordination system, through an extension in longitudinal and width direction which correspond to an X axis and a Y axis, as well as height Z axis. The cross section clarifies the illustration in the YZ-plane.

FIG. 1*a* illustrates one version of coated fibrous web 10 in the form of a one-sided single coated thermo paper. The functional layer is in a form of a thermo-sensitive layer 4, which is visible here on top side 2 of fibrous web F which acts as carrier web T. Regarding the actual design of the thermo-sensitive layer 4 there are a plurality of options. These include at least one color generator and one color developer. These are dispersed in a fixing agent which does not melt, or which melts only insignificantly during heat development.

FIG. 1*b* illustrates through a cross section, an additional embodiment of coated fibrous web 10, where an addition to thermo-sensitive layer 4 in the format an additional protective layer shown here as a cover layer 5 is applied. This is normally a transparent layer. A fibrous web 10 in the embodiment of thermo paper coated in this manner is also described as one-sided double coated thermo paper.

The cross section in FIG. 1*c* illustrates an example of a thermo paper fibrous web 10 that is coated on both sides with a single layer, characterized on the top side 2 and the bottom side 3 respectively by a functional layer in form of a thermo-sensitive layers 4 and 6. In this case too, individual thermo-sensitive layers 4 and 6 completely cover the surfaces on the top side 2 and bottom side 3.

Figure 2:
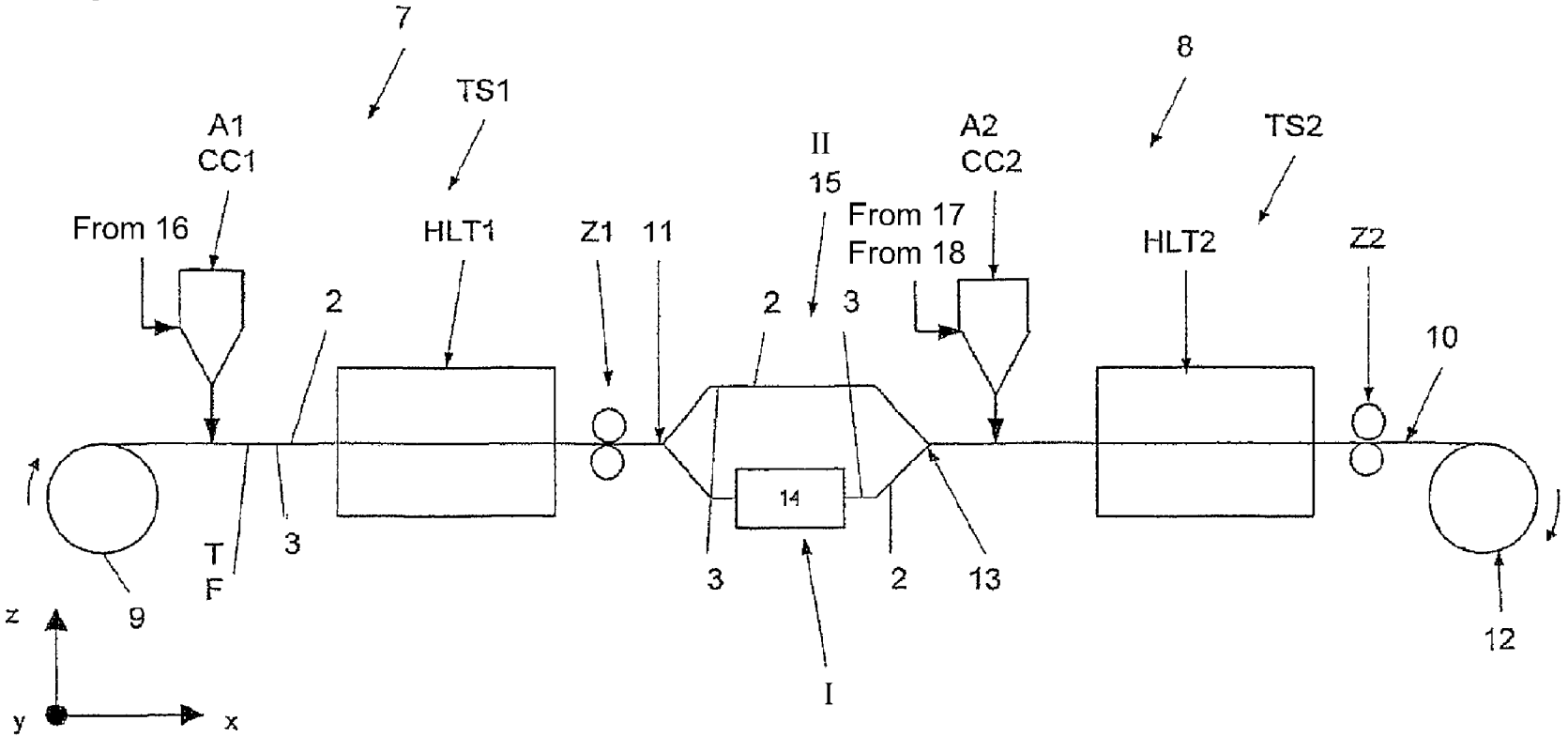
FIG. 2 is a simplified schematic illustration clarifies the basic construction and the basic function of an embodiment of the inventive apparatus of the present invention for the provision of coated paper, cardboard or other fibrous webs with at least one functional layer.

In order to be able to produce the different types of coated paper, cardboard or other fibrous webs 10, especially in the form of so-called thermo papers, depicted in the FIGS. 1*a* through 1*c* simply and cost effectively, appropriate apparatuses 1 for coating or respectively converting of surfaces according to FIGS. 2 through 4 are utilized according to the present invention. These serve to apply at least one thermo-sensitive layer 4 and/or 6 on one side of carrier web T.

Now additionally referring to FIG. 2, there is illustrated a schematically simplified depiction, viewed from aside, the basic arrangement of an inventive apparatus 1 for the production of coated paper, cardboard or other fibrous webs 10 with at least one functional layer in form of a thermo-sensitive layer 4 or 6, which is constructed and designed so that it is suitable to apply several layers, especially a double layer on one surface of a carrier web T, or fibrous web F, or to produce a fibrous web 10, which is coated on both sides.

A coordination system is associated with apparatus 1. The X-direction describes the longitudinal direction of apparatus 1 in which carrier web T is moved through apparatus 1 and which is also referred to as the machine direction. The Y-direction describes the width direction, and the Z-direction refers to the height direction. Apparatus 1 has a total of only two functional layer forming units 7 and 8 for the production of different types of coated paper, cardboard or other fibrous webs 10 according to FIGS. 1*a* through 1*c* which, in direction of the travel of carrier web T in the form of fibrous web F that is to be coated, are located successively and are located between an unwind 9 for the unwinding of carrier web T from a fibrous web roll, and a rewinder 12 for the rewinding of then coated fibrous web 10. Each of the individual functional layer forming units 7 and 8 include at least one applicator device A1 and/or A2 which, in the embodiment of a multi-layer curtain coater CC1 or CC2 is equipped with at least two applicator nozzles. Each applicator device A1 and A2 is respectively followed by a drying section TS1 and TS2. Applicator device A1 and A2 and drying section TS1 and TS2 of each functional layer forming unit 7 and 8 and the associated devices for guidance of carrier web T, generally guide rolls, are arranged so that applicator device A1 and drying section TS1 or respectively A2 and TS2 become effective successively on the same side of carrier web T or fibrous web F. The web path of the carrier web inside functional layer forming units 7 and 8 occurs without directional change, viewed in the machine direction, or respectively without reversal and of the direction. A web turning device 14 is provided between the two functional layer forming units 7 and 8. This allows a turning of carrier web T which includes an orientation change between topside 2 and bottom side 3 of carrier web T, so that now, in the following functional layer forming unit 8 the bottom side 3 faces the applicator device A2. In addition, device 15 to bypass web turning device 14 is provided which, is in the form of a so-called bypass. This is realized in that between the two functional layer forming units 7 and 8 a branching 11 is provided in the web path which allows further routing between the two functional layer forming units 7 and 8 in a first web path I over the web turning device 14, or in a second web path II in direct merging with the successive functional layer forming unit 8.

In functional layer forming units 7 and 8 a pull device Z1 and Z2 is preferably provided. This allows the movement of carrier web T in the form of fibrous web F which is to be coated through apparatus 1.

In the embodiment of the apparatus 1 illustrated in FIG. 2, both functional layer forming units 7 and 8 are located following each other in a horizontal direction of travel, and spatially in a longitudinal direction of apparatus 1, whereby the layout in the illustrated example occurs preferably in a horizontal plane, which is characterized by the X- and Y-directions. The design illustrated in FIG. 2 is characterized by a uniform directional progression for the transport direction of fibrous web F that is to be coated, through the two functional layer forming units 7 and 8 of apparatus 1. Fibrous web F, which is to be coated, does not experience a reversal of travel direction between unwind 9 and rewinder 12, not even after passing through web turning device 14.

Applicator devices A1 and A2 are in the embodiment of a multilayer curtain coaters to supply at least two coating medium layers. Applicator devices of this type are known already in various designs. They include at least two applicator nozzles extending across the machine width, that is in the Y-direction. These curtain coaters can be in the embodiment of a slot die, which may also be in the form of a twin die or tandem die, as well as in the embodiment of a slide die, including at least two discharge lips extending across the width of the machine which are connected respectively with a supply channel which is slanted vertically.

The coating medium falls from the respective applicator nozzle at a break-line, in a free-fall and thus forms a curtain, that flows onto carrier web T, or fibrous web F moving below it. The application may occur directly from the nozzle in a free fall onto the respective surface of moving fibrous web F, or indirectly over a slide plate located between them onto which the coating medium is added through the nozzle and which, in a flow direction of the coating medium also forms a break-line for the creation of a curtain of coating medium.

With the aforementioned slot die, the break-line is formed on its outlet opening. The break-line is always to be understood to be the line at which the coating medium enters the free fall.

Each curtain coater further includes at least one coating medium feed which is indicated by an arrow and through which the applicator nozzle is supplied with coating medium from a coating medium supply system 16 or 17. In an especially advantageous further development curtain coater CC2 can be connected with its applicator nozzle of the second functional layer forming unit 8 with at least two coating medium supply systems 17 and 18.

Various operational modes lead to the production of the coated paper, cardboard or other fibrous webs 10 according to FIGS. 1*a* through 1*c* and which essentially only differ in the mode of carrier web routing in the merging region between the two functional layer forming units 7 and 8 and the activation/deactivation of them are contemplated with the inventive apparatus 1.

In order to achieve a coated fibrous web 10 according to FIG. 1*a* with the arrangement according to FIG. 2, only the first functional layer forming unit 7 is activated in a first operational mode. Fibrous web F receives an application on top surface 2 from curtain coater CC1. Web F is subsequently fed into drying section TS1 and, after passing through this, is routed through pull device Z1 and through the non-activated second functional layer forming unit 8.

"Non-activated" means that drying section TS2 is deactivated, and no coating medium application occurs through curtain coater CC2. In the simplest case scenario, the coating medium supply to applicator device CC2 is interrupted.

In order to achieve a one-sided double coated fibrous web 10 according to FIG. 1*b* with a thermo-sensitive layer 4 on top side 2 and a cover layer 5 in the form of a protective layer on top of it, fibrous web F is routed, in a second operational mode, through both functional layer forming units 7 and 8 which are both activated. Here, fibrous web is routed in the merging region over second web path II in bypassing web turning device 14. This means that no change in the alignment of top side 2 and bottom side 3 occurs and the second functional layer, which is applied preferably in the form of cover layer 5 as a protective layer, is then applied through second curtain coater CC2 onto the already existing functional layer in form of thermo-sensitive layer 4. Subsequently, a curing occurs during travel through drying section TS2, whereby coated fibrous web 10 is rewound after reaching the required dry content.

In order to obtain a coated fibrous web 10 according to FIG. 1*c* in the embodiment of a fibrous web 10 coated on both sides with a single layer, apparatus 1 is operated in a third operational mode in such a way that fibrous web F runs through both functional layer forming units 7 and 8; however, between units 7 and 8 fibrous web F is routed to web turning device 14 along web path I, whereby the orientation of top side 2 and bottom side 3 are reversed, so that at the second functional layer forming unit 8 bottom side 3 now faces applicator device CC2 and the application is made onto it.

The arrangement of drying sections TS1 and TS2 can be varied. In the simplest case at least one drying device is located in each drying section TS1 and TS2 which, in the simplest case according to FIG. 2 includes always at least one contactless drying device, especially a hot air dryer HLT1 and HLT2. This is either gas or steam heated.

Figure 3A:
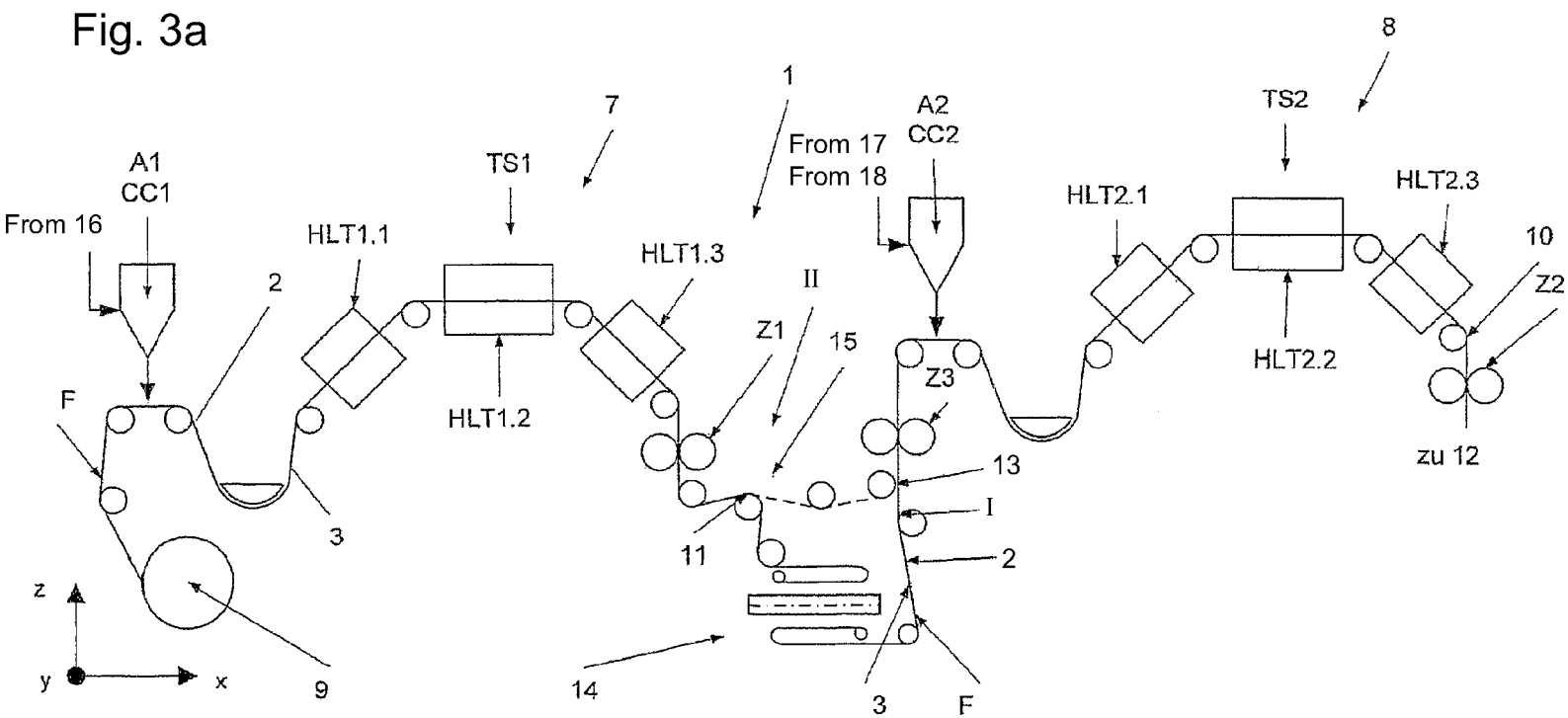
FIGS. 3*a* through 3*c* clarify in a simplified schematic depiction an embodiment of an inventive apparatus to produce coated paper, cardboard or other fibrous webs with at least one functional layer, FIGS. 4*a* through 4*c* clarify in a simplified schematic depiction another embodiment of an inventive apparatus to produce coated paper, cardboard or other fibrous webs with at least one functional layer.

While FIG. 2 illustrates the basic concept of the present invention, FIG. 3*a* depicts an example of a possible design variation in the form of a further development of FIG. 2. Here, the individual devices can be arranged behind each other in a horizontal plane, or in horizontal planes offset from each other. The functional layer forming units 7 and 8 respectively include a multi-layer curtain coater CC1 and CC2, with at least two applicator nozzles, as well as a downstream drying section TS1 and TS2. The individual drying sections TS1 and TS2 respectively are characterized by a plurality of successive drying devices which are in the embodiment of hot air dryers HLT1.1 through HLT1.3, or respectively HLT2.1 through HLT2.3. These are preferably connected in series and located at an angle to each other, so that the available space in a vertical direction is utilized in an optimum manner when installing an appropriately large drying capacity and the space requirement in an axial direction, which is in the machine direction, can be kept to a minimum, in spite of the series-connection of functional layer forming units 7 and 8.

Figure 3C:
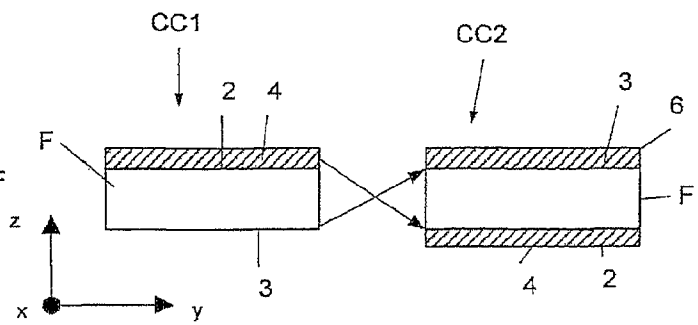
Figure 3B:
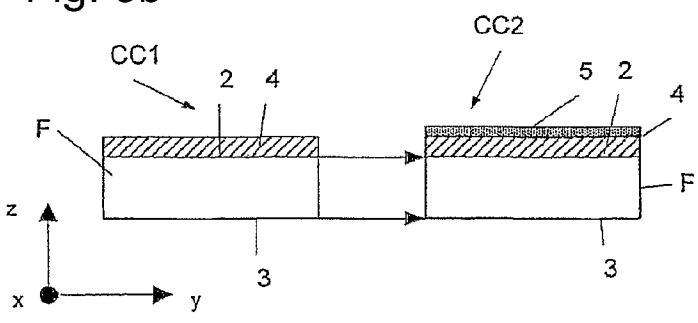

FIG. 3*b* illustrates the operational mode of apparatus 1 whereby a coated fibrous web 10 in the embodiment of a fibrous web F is double coated on one side. The individual process steps are illustrated by a cross section view through a fibrous web F, showing the individual layering, of the individual sides of fibrous web F. It can be seen here that the first functional layer in the form of thermo-sensitive layer 4 is applied onto surface 2 of the carrier web in the embodiment of fibrous web F by first applicator device CC1, and that fibrous web F is guided to the second functional layer forming unit 8 without orientation change between top side 2 and bottom side 3, whereby second functional layer forming unit 8 serves to apply cover layer 5, which functions as the protective layer. The web travel in this case occurs over web path II which is depicted in FIG. 3*a* by way of a broken line. In contrast, FIG. 3*c* illustrates the production of a coated fibrous web 10 in the embodiment of a fibrous web F which is single coated on both sides. It can be seen that the two sides, top side 2 and bottom side 3, after running through second functional layer forming unit 8 are coated. This is accomplished by routing web F over web path I, which includes web turning device 14, which causes a change in orientation between top side 2 and bottom side 3. This results in coating being applied to bottom side 3 which was hitherto without coating in second functional layer forming unit 8. This change of orientation is indicated by the arrows in FIG. 3*c*.

The merging regions between the two functional layer forming units 7 and 8 shown in FIGS. 2 and 3 are preferably arranged and configured so that web paths I and II, which are defined by web turning device 14 and related bypass 15 are aligned parallel to each other.

The arrangement illustrated in FIG. 3*a* is characterized by preferably three pull devices Z1 through Z3. The two pull devices Z1 and Z2 are located after the two functional layer forming units 7 and 8 as illustrated in FIG. 2. An additional pull device Z3 is located after merging point 13 and before applicator device A2 of second functional layer forming unit 8.

Figure 4A:
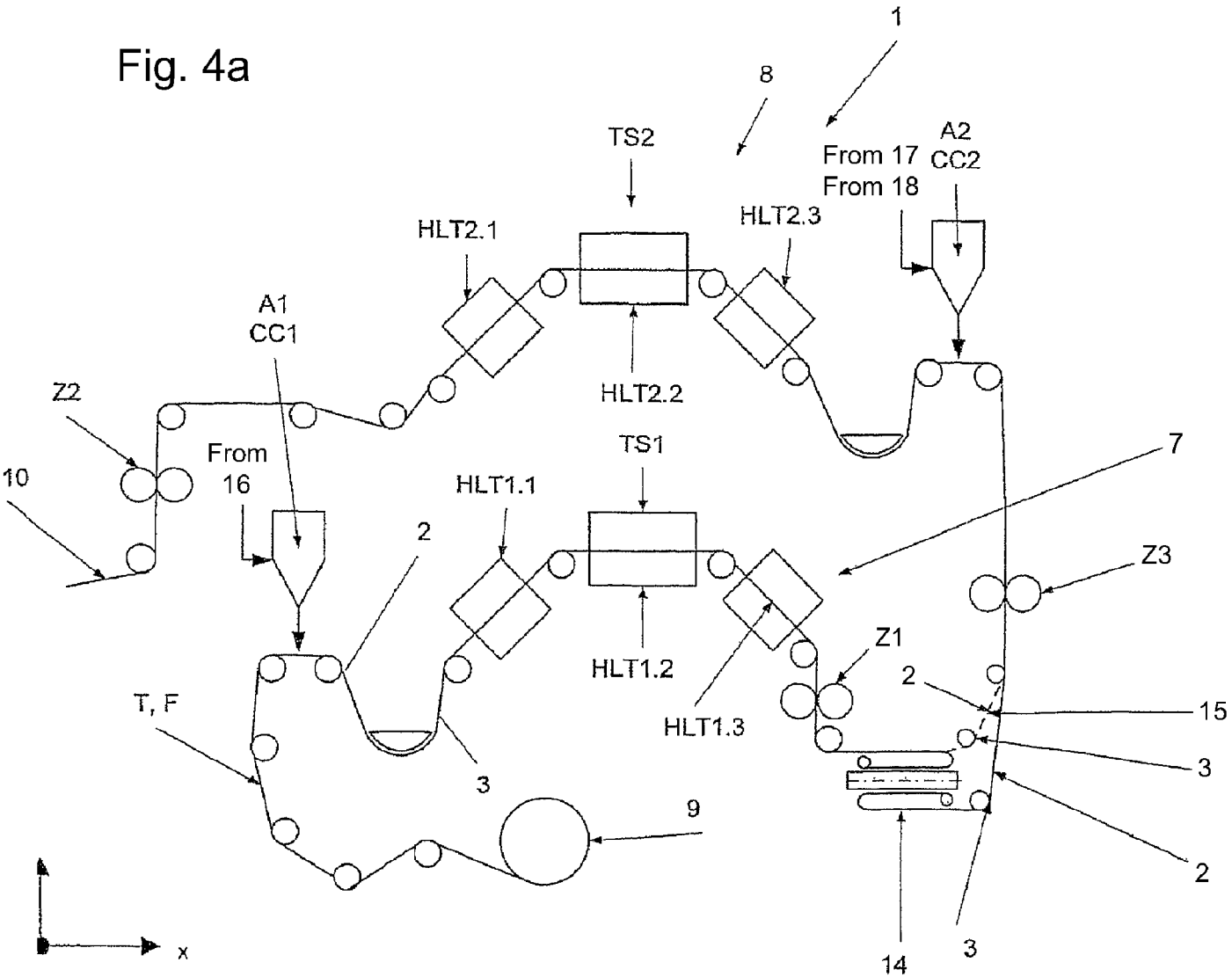
Figure 4B:
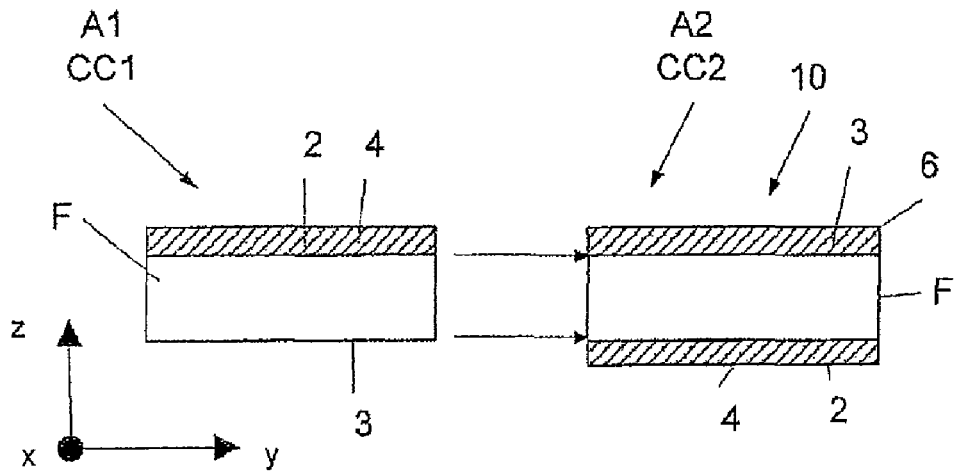
Figure 4C:
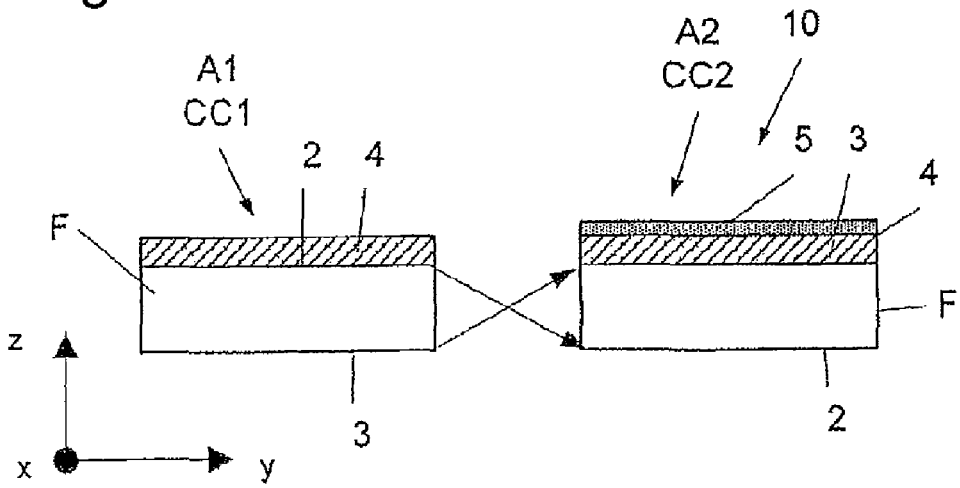

In contrast to the arrangements illustrated in FIGS. 2 and 3, FIG. 4*a* shows an example of an additional arrangement whereby the individual functional layer forming units 7 and 8 are located in different vertical locations. In addition a directional change in the web path is achieved. In the illustrated example the two functional layer forming units 7 and 8 are preferably located on top of each other in a vertical direction, so that the machine length in the machine direction, which describes the X-direction, can be kept relatively short. The equipment space in the vertical direction can be used to an optimum. The arrangement of applicator devices A1 and A2 and drying sections TS1 and TS2 occurs so that carrier web T in the embodiment of the fibrous web F that is to be coated runs through the individual functional layer forming units 7 and 8 in opposite directions relative to the longitudinal direction of apparatus 1. Preferably the merging region is allocated to one of the two functional layer forming units 7 or 8 and is located in one plane with it. The web travel still occurs in the same direction as in the functional layer forming unit which is located in the same plane.

In the illustrated example the merging region is preferably located immediately following the functional layer forming unit 7, whereby fibrous web F which functions as carrier web T runs into it still in an unchanged direction. However, a relocation in vertical direction into the second functional layer forming unit 8, which is located above, or respectively before it is also contemplated. The actual constructive design depends on the requirements of the individual application. The basic construction of the two functional layer forming units 7 and 8 corresponds to the description in FIGS. 2 and 3. The same references have therefore been given to the same components. In this case too, the individual drying section TS1 and TS2 respectively includes a plurality of series connected individual drying devices, in this case hot air dryers HLT1.1 through HLT1.3, or respectively HLT2.1 through HLT2.3 which become effective successively on fibrous web F running through them or on fibrous web F traveling past them.

In addition to the arrangements illustrated in FIGS. 2 and 3 with a constant travel direction for fibrous web F that is to be coated through apparatus 1 the arrangement in FIG. 4*a* is characterized in that just based on the layout, which causes a directional change in the path of the fibrous web F, a change in orientation in web path II between top side 2 and bottom side 3 is created. In this arrangement, in order to maintain the same orientation of top side 2 and bottom side 3, fibrous web F is guided over web turning device 14, while otherwise a reversal in orientation between top side 2 and bottom side 3 relative to the unit 8 which forms the next functional layer automatically occurs in the bypass of web turning device 14. Accordingly, when utilizing the web path II and successively running over functional layer forming units 7 and 8 according to FIG. 4*b*, a fibrous web 10 with single layer coating on both sides can be produced. In contrast, in order to achieve a fibrous web 10 with a double layer coating on one side it is necessary according to FIG. 4*c* to guide fibrous web F over web turning device 14, especially along first web travel path I. In this case the application of thermo-sensitive layer 4 occurs in first functional layer forming unit 7 by way of first curtain coater CC1 onto top side 2 of fibrous web F which, after curtain coater CC1 runs through drying section TS1 and is led in the merging region to second functional layer forming unit 8, over web turning device 14 so that a reversal in the orientation between top side 2 and bottom side 3 occurs and that therefore top side 2 is coated again with one additional layer, preferably a cover layer 5.

It must also be mentioned that if only one layer is applied to one web side, only one applicator die, or respectively applicator nozzle of the multi-layer applicator device is activated. If more layers are applied, accordingly more nozzles or feeds are activated.

The inventive solution is not limited to the arrangements illustrated in FIGS. 2 through 4. It permits an application of at least two layers with a single applicator device, whereby the type of the application is variable and is determined only by the operational mode of apparatus 1, as well as by the coating medium which is applied through the applicator device. In addition, simple fibrous webs F with a single layer coating on one side can also be produced in a simple manner with apparatus 1.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

COMPONENT IDENTIFICATION LIST

1 Apparatus to produce a coated fibrous web
2 Top side
3 Bottom side
4 Thermo-sensitive layer
5 Cover layer
6 Thermo-sensitive layer
7 Functional layer forming unit
8 Functional layer forming unit
9 Unwind
10 Coated fibrous web
11 Branching
12 Rewinder
13 Merging
14 Web turning device
15 Means to bypass the web turning device
16 Coating medium supply system
17 Coating medium supply system
18 Coating medium supply system
I first web path
II second web path
A1 Applicator device
A2 Applicator device
CC1 Curtain coater
CC2 Curtain coater
HLT1.1-HLT.1.3 Hot air dryer
HLT2.1-HLT2.3 Hot air dryer
TS1 Drying section
TS2 Drying section
X Longitudinal direction
Y Width direction
Z Height direction
F Fibrous web
T Carrier web

What is claimed is:

1. An apparatus to produce coated paper, cardboard or other fibrous webs with at least one thermo-sensitive layer as a functional layer through the application of at least one liquid or paste-like thermo-sensitive coating medium onto a carrier web, the apparatus comprising:

a first unit; and a second unit, both said first unit and said second unit being configured to form a functional layer on the carrier web, said first unit and said second unit each including:

at least one applicator device; and a drying section following said applicator device;

a web turning device, said first unit and said second unit being installed in series whereby each form at least one functional layer, said web turning device being located in a merging area between said first unit and said second unit, when the carrier web passes through said web turning device the carrier web defines a first web path; and a bypass device to bypass said web turning device defining a second web path for the carrier web between said first unit and said second unit.

2. The apparatus of claim 1, wherein said bypass device includes at least one of guide elements and control elements to guide the carrier web, said guide elements and said control elements being located and configured to create a branching of the carrier web to follow one of said first web path and said second web path after said first unit, said bypass device additionally bringing together the two web paths before the web reaches said second unit.

3. The apparatus of claim 1, wherein said applicator device and said drying section in both said first unit and said second unit are configured and arranged so that the carrier web is guided inside said first unit and said second unit without a reversal of direction of the web as viewed in a longitudinal direction of the apparatus.

4. The apparatus of claim 3, wherein said applicator device and said drying section of said first unit are arranged in a horizontal plane, said applicator device and said drying section of said second unit also being arranged in a horizontal plane.

5. The apparatus of claim 3, wherein said applicator devices and said drying sections of said first unit and said second unit are arranged in planes vertically offset from each other.

6. The apparatus of claim 1, wherein said first unit and said second unit as viewed in a longitudinal direction of the apparatus are arranged in tandem.

7. The apparatus of claim 6, wherein said first unit and said second unit are arranged in a horizontal plane.

8. The apparatus of claim 6, wherein said first unit and said second unit are arranged in a vertical direction, offset from each other.

9. The apparatus of claim 1, wherein said at least one applicator device of said first unit is a first curtain coater, said at least one applicator device of said second unit being a second curtain coater, said first curtain coater and said second curtain coater each including at least one applicator nozzle extending in a width direction of the carrier web, said first curtain coater and said second curtain coater each being connected through at least one coating medium feed line with at least one coating medium supply system.

10. The apparatus of claim 9, wherein said at least one coating medium supply system includes a first coating medium supply system and a second coating medium supply system, said first coating medium supply system and said second coating medium supply system supply different coating mediums and are both allocated to one of said first curtain coater and said second curtain coater, said first coating medium supply system and said second coating medium supply system being selectively activated, at least one of said coating medium supply systems containing a thermo-sensitive coating medium.

11. The apparatus of claim 1, wherein said drying section of both said first unit and said second unit include at least one drying device.

12. The apparatus of claim 11, wherein said drying devices are a hot air dryer which is heated by one of steam and gas.

* * * * *